US007073698B2

(12) United States Patent
Frommelt et al.

(10) Patent No.: US 7,073,698 B2
(45) Date of Patent: Jul. 11, 2006

(54) EXPLOSION POWER-OPERATED SETTING TOOL

(75) Inventors: Markus Frommelt, Schaan (LI); Franz Buechel, Ruggell (LI); Tilo Dittrich, Gams (AT); Stefan Boenig, Achberg-Esseratsweiler (DE)

(73) Assignee: Hilti Akitengesellschaft, Schaan (LI)

( * ) Notice: Subject to any disclaimer, the term of this patent is extended or adjusted under 35 U.S.C. 154(b) by 0 days.

(21) Appl. No.: 11/011,825

(22) Filed: Dec. 14, 2004

(65) Prior Publication Data

US 2005/0167463 A1 Aug. 4, 2005

(30) Foreign Application Priority Data

Dec. 15, 2003 (DE) ..... 103 58 576

(51) Int. Cl.
*B25C 1/04* (2006.01)

(52) U.S. Cl. ..... 227/10

(58) Field of Classification Search ..... 227/4, 227/7, 10, 120, 134, 156; 267/137, 139, 267/140, 155

See application file for complete search history.

(56) References Cited

U.S. PATENT DOCUMENTS

| | | | | |
|---|---|---|---|---|
| 3,331,546 | A * | 7/1967 | Brunelle | 227/10 |
| 3,565,313 | A * | 2/1971 | Seghezzi et al. | 227/10 |
| 3,820,703 | A * | 6/1974 | Rangger | 227/10 |
| 4,122,987 | A * | 10/1978 | Jochum et al. | 227/10 |
| 4,134,527 | A * | 1/1979 | Termet | 227/10 |
| 4,374,567 | A * | 2/1983 | Combette et al. | 227/10 |
| 4,941,391 | A * | 7/1990 | Ehmig et al. | 89/1.14 |
| 5,901,894 | A * | 5/1999 | Melocco | 227/10 |
| 6,029,878 | A * | 2/2000 | Pfister et al. | 227/10 |
| 6,053,388 | A * | 4/2000 | Pfister et al. | 227/10 |
| 6,123,243 | A * | 9/2000 | Pfister et al. | 227/10 |
| 6,938,811 | B1 * | 9/2005 | Ehmig et al. | 227/10 |

* cited by examiner

*Primary Examiner*—Stephen F. Gerrity
*Assistant Examiner*—Paul Durand
(74) *Attorney, Agent, or Firm*—Abelman, Frayne & Schwab

(57) ABSTRACT

An explosion-power operated setting tool for driving fastening elements in a structural component includes a setting piston (15) displaceably arranged in the guide chamber (14) of a piston guide (13) arranged, at least partially, in the tool housing (11), a resetting device (30) having a resetting member (31) for returning the setting piston (15) in its initial position (25) after completion of a setting process, and a spring (35) for resiliently biasing the resetting member (31) in a direction of its initial position, and a damping device (40) for the spring (35).

6 Claims, 2 Drawing Sheets

EXPLOSION POWER-OPERATED SETTING TOOL

BACKGROUND OF THE INVENTION

1. Field of Invention

The present invention relates to an explosion power-operated setting tool for driving fastening elements in a structural component and including a housing, a piston guide arranged, at least partially, in the housing and having a guide chamber, a setting piston displaceably arranged in the guide chamber of the piston guide, a resetting device having a resetting member for returning the setting piston in its initial position after completion of a setting process, and a spring for resiliently biasing the resetting member in a direction of its initial position.

2. Description of the Prior Art

Setting Tools of the type described above are driven, e.g., with solid fuels in form of cartridges, which are filled with an explosive powder, or in form of pellets which are formed of a compressed explosive powder. The setting tools includes a housing, a piston guide arranged, at least partially in the housing, and a setting piston displaceably arranged in the piston guide. In these setting tools, the setting piston is driven by combustion gases of the fuel. With the setting piston, fastening elements such as nails, bolts, etc. are driven in constructional components. After completion of each setting process, the setting piston should return into its initial position.

German Publication DE-19749027A1 discloses a hand-held, explosive powder charge-operated setting tool which includes a setting piston resetting device. The resetting of the setting piston is effected with a spring-biased, lever-shaped resetting member which forms part of the resetting device and which pivots relative to the housing in a plane extending in the setting direction. The lever-shaped resetting member projects through a side opening of the piston guide into the interior of the piston guide and cooperates therewith a driving surface of the setting piston facing in the setting direction. The resetting member pivots about a rotational axle supported in the setting tool housing. The biasing spring, which cooperates with the resetting member is supported, on one hand against the housing and, on the other hand, against a stop or rear surface of the lever-shaped resetting member. Upon displacement pivots up to a stop on a damping member and, thereby, the spring becomes pre-loaded. After the completion of a setting process, the spring is relaxed, providing for pivoting of the resetting member in a direction opposite to the setting direction until the setting piston is returned to its initial position.

The drawback of the known setting tool consists in that the preloading of the spring of the resetting device during the setting process takes place at a high deflection speed, which leads to transient oscillations and a following natural oscillation. These oscillations result in a short service life of the spring.

Accordingly, an object of the present invention is a setting tool of the type described above and in which the foregoing drawback is eliminated, and the resetting device has an improved service life.

SUMMARY OF THE INVENTION

This and other objects of the present invention, which will become apparent hereinafter are achieved, by providing a setting tool including a damping device for the resetting spring.

By providing a damping device, impact shocks and oscillations, which act on the spring, are noticeably reduced, whereby the service life of the spring and, thereby, of the resetting device is increased.

Advantageously, the damping device includes a damping member which is arranged between an end of the spring and a bearing section of the resetting member. Thereby, shocks, which are transmitted from the resetting member to the spring, can be damped, which results in reduction of the natural oscillation of the spring.

Advantageously, the spring is formed as a torsion spring, and the resetting device includes a pivot axle on which the spring is pivotally supported, with the damping device including a damping member arranged between the pivot axle and the spring. With a damping member arranged between the pivot axle and the spring, an inner damping of the spring is effected in a simple manner.

A further improvement in dampening of the spring is achieved by forming the damping member, which is provided between the pivot axle and the spring, as a damping sleeve. With this, advantageously, the outer diameter of the damping sleeve corresponds to the inner diameter of the spring.

When the damping member is formed as a damping sleeve, it is advantageously formed of two separate sleeve elements. Thereby, a torsional effect and, thereby, friction and hysteresis are prevented. Further, the sleeve elements can be provided with axial slots, which insures compensation of radial tolerances.

Advantageously, each of the two damping members, which are provided, respectively, between one of the spring end and the resetting member and between the pivot axle and the spring, or both of them are formed, at least partially of an elastomeric material, e.g., of a dampable, elastomeric plastic material. The use of an elastomeric material insures a long service life of the damping member(s).

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiment, when read with reference to the accompanying drawings.

DETAILED DESCRIPTION OF THE PREFERRED EMBODIMENTS

Figure 1:
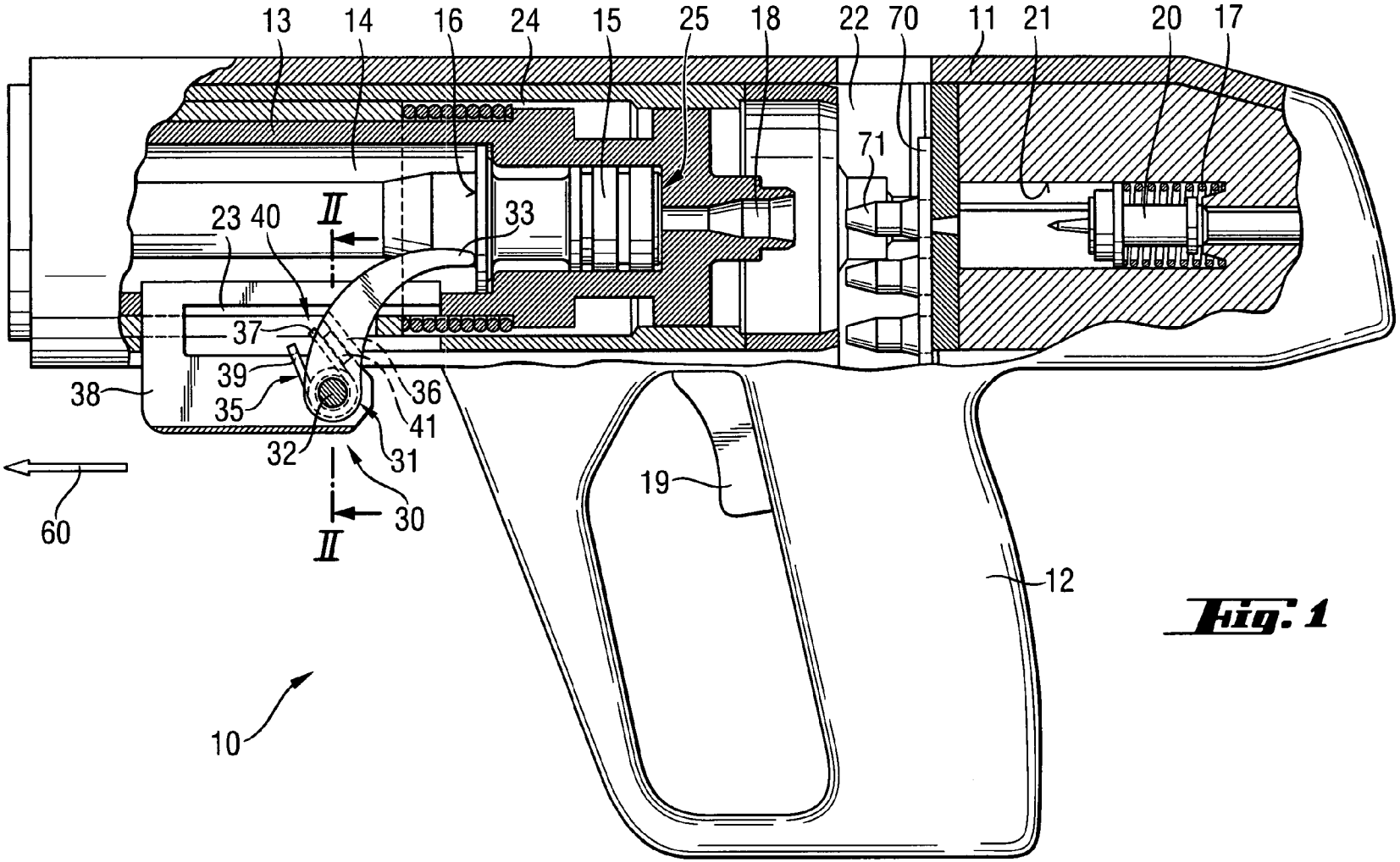
FIG. 1 a side, partially cross-sectional view of a setting tool according to the present invention.
Figure 2:
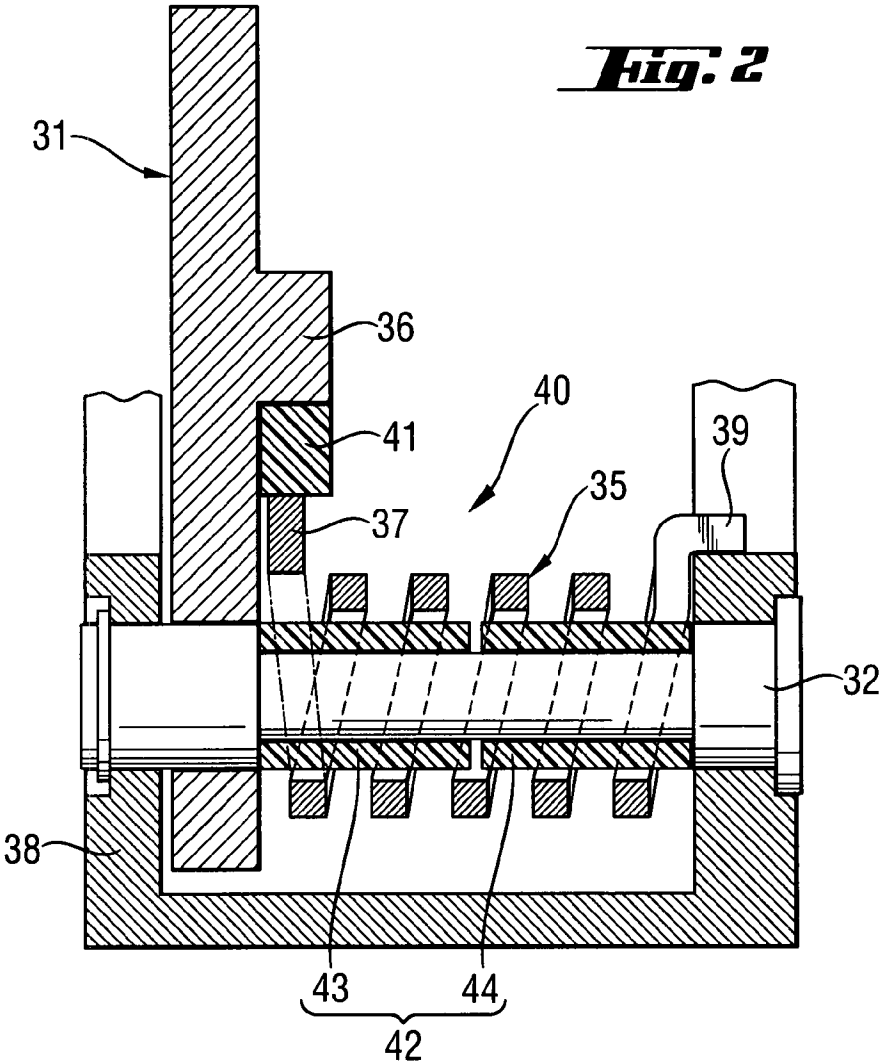
FIG. 2 a cross-sectional view of the setting tool shown in FIG. 1 along line II—II in FIG. 1.

An explosion power-operated setting tool 10 according to the present invention, which is shown in FIGS. 1–2, has a one-or multi-part housing 11 having a sleeve-shaped receiving chamber 24, a piston guide 13 displaceably arranged in the receiving chamber 24, and a spring that provides for support of the piston guide 13 in the housing 11 and that biases the piston guide 13 in a setting direction 60. A setting piston 15 is arranged in the guide chamber 14 of the piston guide 13 for axial displacement therein. The setting piston 15 is driven by a propellant, e.g., such as a cartridge 71 which is placed in the cartridge chamber 18. An ignition element such as, e.g., a firing pin 20, which is displaceable in a firing pin guide 21 and is biased by a spring 17, serves for ignition of cartridge 71 to be located in the cartridge chamber 18. The cartridges 71 can be stored in a propellant magazine strip 70 displaceable in a guide channel 22.

In the embodiment shown in the drawings, a handle 12 is provided on the housing 11. The handle 12 carries an actuation switch 19 for initiating a setting process by a user of the setting tool 10.

The setting tool 10 further includes a resetting device, which is generally designated with a reference numeral 30, for the setting piston 15. The resetting device 30 includes a lever-shaped resetting member 31, which is formed as a pivot lever pivotally supported on a pivot axle 32 provided on a support 38. The resetting member 31 extends through an opening 23 in the piston guide 13 and has its free end 33 engaging a driving surface 16 of the setting piston 15 which faces in the setting direction 60. A spring 35, which is formed as a torsion spring, resiliently biases the resetting member 31 toward the driving surface 16 of the setting piston 15. The spring 35 is supported, on one hand, with its first end 37 against a bearing section 36 of the resetting member 31 and, on the other hand, with its second end 39 against the support 38 (see in particular FIG. 2). There is further provided a damping device 40 for the spring 35. The damping device 40 has two damping members 41 and 42. The damping member 41 is arranged between the first end 37 of the spring 35 and a bearing section 36 that is formed as a rib. The damping member 42 is arranged between the axle 32 and the spring 35. The damping member 42 is formed of two sleeve elements 43 and 44 separated from each other. The damping device 40 can also include an additional damping member (not shown) that can be arranged between the second end 39 of the spring 35 and the support 38. Further, the damping of the spring 35 can be effected with a plurality of intermediate damping members.

In the embodiment of the setting tool 10 shown in FIG. 1, the setting piston 15 is located at an end of the piston guide 13 adjacent to the cartridge chamber 18, and is held in this position, which is designated with a reference numeral 25, with the resetting member 31. When a cartridge 71 in the cartridge chamber 18 is ignited with the firing pin 20 or another ignition element, the piston 15 is displaced by the explosion power in the setting direction 60. The setting piston 15 entrains the lever-shaped resetting member 31, which preloads the spring 35. The impact shock which is applied to the spring 35, and the resulting vibrations is damped by the damping device 40, the damping members 41, 42, which increases the service life of the spring 35. Likewise, the damping device 40, the damping members 41, 42, damps impacts shocks and vibrations, which are imparted to the spring 35, when the setting piston 35 is displaced in its initial position 25.

Though the present invention was shown and described with references to the preferred embodiment, such is merely illustrative of the present invention and is not to be construed as a limitation thereof and various modifications of the present invention will be apparent to those skilled in the art. It is therefore not intended that the present invention be limited to the disclosed embodiment or details thereof, and the present invention includes all variations and/or alternative embodiments within the spirit and scope of the present invention as defined by the appended claims.

What is claimed is:

1. An explosion-power operated setting tool for driving fastening elements in a structural component, comprising a housing (11), a piston guide (13) arranged, at least partially, in the housing (11) and having a guide chamber (14), a setting piston (15) displaceable arranged in the guide chamber (14) of the piston guide (13), a resetting device (30) having a resetting member (31) for returning the setting piston (15) in an initial position (25) thereof after completion of a setting process, and a spring (35) for resiliently biasing the resetting member (31) in a direction of the initial position (25) of the setting piston (15), and a damping device (40) for the spring (35), wherein the damping device (40) comprises a damping member (41) arranged between an end (37) of the spring (35) and a bearing section (36) of the resetting member (31).

2. A setting tool according to claim 1, wherein the damping member (41) is formed, at least partially, of an elastomeric material.

3. An explosion-power operated setting tool for driving fastening elements in a structural component, comprising a housing (11), a piston guide (13) arranged, at least partially, in the housing (11) and having a guide chamber (14), a setting piston (15) displaceable arranged in the guide chamber (14) of the piston guide (13), a resetting device (30) having a resetting member (31) for returning the setting piston (15) in an initial position (25) thereof after completion of a setting process, and a spring (35) for resiliently biasing the resetting member (31) in a direction of the initial position (25) of the setting piston (15), and a damping device (40) for the spring (35), wherein the spring (35) is formed as a torsion spring, and the resetting device (30) further comprises a pivot axle (32) on which the spring (35) is pivotally supported, and wherein the damping device (40) comprises a damping member (42) arranged between the pivot axle (32) and the spring (35).

4. A setting tool according to claim 3, wherein the damping member (42) is formed as a damping sleeve.

5. A setting tool according to claim 4, wherein the damping sleeve is formed at least of one first sleeve element (43) and one second sleeve element (44).

6. A setting tool according to claim 3, wherein the damping member (42) is formed, at least partially, of an elastomeric material.

* * * * *